US007673421B2

(12) United States Patent
Pilz

(10) Patent No.: US 7,673,421 B2
(45) Date of Patent: Mar. 9, 2010

(54) BUILDING CONSTRUCTION PRODUCT DIRECTED TO MINIMIZING WATER ACCUMULATION AT FLOOR JOINTS

(76) Inventor: Donald A. Pilz, 918 Elaine Ave., Livermore, CA (US) 94550

( * ) Notice: Subject to any disclaimer, the term of this patent is extended or adjusted under 35 U.S.C. 154(b) by 171 days.

(21) Appl. No.: 11/781,939

(22) Filed: Jul. 23, 2007

(65) Prior Publication Data

US 2008/0016808 A1 Jan. 24, 2008

Related U.S. Application Data

(60) Provisional application No. 60/820,196, filed on Jul. 24, 2006, provisional application No. 60/820,173, filed on Jul. 24, 2006, provisional application No. 60/893,339, filed on Mar. 6, 2007.

(51) Int. Cl.
*E04D 1/36* (2006.01)
*E04D 3/38* (2006.01)
*E04D 13/14* (2006.01)

(52) U.S. Cl. ..... 52/60; 52/58; 52/97; 52/302.6; 52/365; 52/372

(58) Field of Classification Search ..... 52/58, 52/60, 61, 62, 97, 302.1, 302.6, 365, 371, 52/372, 376
See application file for complete search history.

(56) References Cited

U.S. PATENT DOCUMENTS

| | | | | |
|---|---|---|---|---|
| 1,624,121 | A * | 4/1927 | Thiem | 52/371 |
| 4,785,601 | A * | 11/1988 | Tupman | 52/364 |
| 6,374,559 | B1 * | 4/2002 | Rutherford | 52/393 |
| 2006/0254169 | A1 * | 11/2006 | McFadden | 52/344 |
| 2007/0062137 | A1 * | 3/2007 | Maylon | 52/367 |
| 2007/0130861 | A1 * | 6/2007 | Chenier et al. | 52/371 |

* cited by examiner

*Primary Examiner*—Basil Katcheves
*Assistant Examiner*—Brandon C Painter
(74) *Attorney, Agent, or Firm*—Knobbe, Martens, Olson & Bear, LLP

(57) ABSTRACT

An embodiment of a stucco wall device is configured to provide alignment in uneven wall joints, allow water to drain out of the wall, protect against water infiltration, and permit movement between the two sides of a joint. An embodiment includes two pieces which form a seal and a sloped screed with weep holes for directing water out of and away from the wall. A male leg of the second piece slides between the first piece and the wall, allowing the two pieces to move relative to each other while preserving a seal against water infiltration. Other embodiments include one-piece stucco wall devices which also allow movement between the joint members and are configured to protect against water infiltration into a wall. Portions of a wall device may be adjusted or bowed in order to assist in alignment at an uneven wall joint.

22 Claims, 15 Drawing Sheets

BUILDING CONSTRUCTION PRODUCT DIRECTED TO MINIMIZING WATER ACCUMULATION AT FLOOR JOINTS

RELATED APPLICATIONS

This application claims the benefit under 35 U.S.C. §119 (e) of U.S. Provisional Application No. 60/820,196, filed Jul. 24, 2006, entitled STUCCO SCREED FLASHING; and of U.S. Provisional Application No. 60/820,173, filed Jul. 24, 2006, entitled STUCCO M-SLIDE EXPANSION JOINT; and of U.S. Provisional Application No. 60/893,339, filed Mar. 6, 2007, entitled FLOOR LINE CONTROL JOINT STUCCO TRIM. The entire contents of the above-mentioned provisional patent applications are hereby incorporated by reference herein and made a part of this specification.

BACKGROUND OF THE INVENTION

1. Field of the Invention

Certain embodiments disclosed herein relate to stucco accessories.

2. Description of the Related Art

The use of stucco wall claddings in the construction industry is well known. However, excessive water can infiltrate stucco walls through typical cracks and separations at accessories, causing mold growth and other problems. Furthermore, performance expectations of stucco walls have increased over the years, and new building materials present new problems. Materials such as Douglas fir, paper-faced sheathing and fully insulated wall cavities promote mold growth with only minimal water infiltration. The transition to energy efficient buildings has also provided less opportunity for moisture to evaporate from the exterior claddings, thus exacerbating the conditions for mold growth. Past stucco accessories and expansion joints have not successfully solved the mold growth problem due to water infiltration and a lack of drainage capabilities.

Expansion joint devices have been used in stucco walls to protect against cracking or other problems due to movement of the different wall sections. In general, these devices allow a certain amount of movement between adjacent sections of stucco wall. Previous devices have not allowed enough movement which usually causes the joint to break and lose any water protection capabilities.

Another problem with stucco wall claddings is that there is often misalignment from floor line to floor line. This misalignment makes it difficult to install expansion joints without the time consuming task of installing shims to align the joint. With past stucco expansion joints, alignment by using shims was very important in order to protect against water infiltration and also for esthetic reasons. Previous expansion joints have not provided any way to be properly aligned with out the use of shims or other difficult measures.

U.S. Pat. No. 3,015,194 discloses an expansion joint used in stucco walls. However, it does not provide any means of protection against water infiltration or drainage. It also does not disclose any way of aligning the joint without shims. Similarly, the U.S. Pat. No. 3,331,176 is also an expansion joint which does not provide sufficient water protection or any means for drainage. Neither does it provide means for aligning the joint without shims.

The expansion joint in U.S. Pat. No. 4,785,601 also discloses a type of control screed for plaster walls. However, it does not provide any way for water within the stucco assembly to drain out. The disclosed screed locks in the water within the stucco which can be detrimental to the stucco or plaster and also promotes mold growth. The disclosed screed does not provide any means for its use in an uneven joint without the costly use of shims. Further, any seal against water is ineffective because there is nothing forcing the ground screed on the two pieces to contact each other in order to form a seal. The movement in such a joint is also very limited due to the relatively short inserted portion and groove.

U.S. Pat. No. 6,374,559 is an expansion joint device which allows some movement between the stucco wall sections; however, it does not provide enough movement. Often, the wall sections move such that the tongue releases from the groove and then the joint breaks and there is no seal for water protection. Also, the seal is not durable and often breaks or loses its sealing capacity. Another problem is that the joint material is stiff and provides no means for aligning the joint when the surfaces are uneven.

SUMMARY OF THE INVENTION

Embodiments of the present invention overcome all of the problems discussed above including water infiltration and drainage, expansion/movement capabilities, and alignment. An embodiment provides a flashing leg that has the ability to incorporate self-adhered flashing into the stucco assembly as to protect from water infiltration. Embodiments also provide drainage for water in the stucco assembly via sloped screed points and weep holes in the screed. Further, certain embodiments also simplify installation by including a series of bends within the accessory that bring the screed points into alignment without the use of shims.

In one embodiment, the expansion joint is made up of two pieces, the bottom piece having a male leg which slides snugly behind or within the top piece and permits substantial movement between the two pieces. The top piece includes a sloped screed which provides drainage for moisture in the stucco assembly. A sequence of bends in the top piece help press the sloped screed firmly against the male leg of the bottom piece, thus assuring water protection and joint alignment in uneven joints. Weep holes in the sloped screed provide additional means for water to escape. The top piece also includes a flashing/fastening leg which protects against water infiltration. In one embodiment, the two-piece joint is bowed outwardly as to accommodate for offset wall joints and allow more efficient alignment without the use of shims.

According to another embodiment, an expansion joint comprises one-piece with a flashing leg which protects against water infiltration. A sloped screed allows water or moisture to drain out of the stucco assembly. A lower leg of expanded metal lath provides movement or expansion in the joint. Optionally, the lower leg can be solid with vertical slots or can have a drill-hole pattern throughout. In one embodiment, the lower leg is offset so that the joint can be aligned without the use of shims.

According to another embodiment, an expansion joint comprises one piece with an upper leg which protects against water infiltration and a sloped screed which allows water drainage. Weep holes in the sloped screed also promote water drainage. Counter flashing on the lower portion of the joint diverts water away from the stucco assembly. In one embodiment, a return key connected to the counter flashing provides water protection even if there is movement in the joint. Also, the shape of the counter flashing can be varied in order to account for uneven surfaces and still provide water protection.

Certain objects and advantages of the invention are described herein. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of the embodiments summarized above are intended to be within the scope of the invention herein disclosed. However, despite the foregoing discussion of certain embodiments, only the appended claims (and not the present summary) are intended to define the invention. The summarized embodiments, and other embodiments of the present invention, will become readily apparent to those skilled in the art from the following detailed description of the preferred embodiments having reference to the attached figures, the invention not being limited to any particular embodiment(s) disclosed.

DETAILED DESCRIPTION OF THE PREFERRED EMBODIMENT

Figure 1:
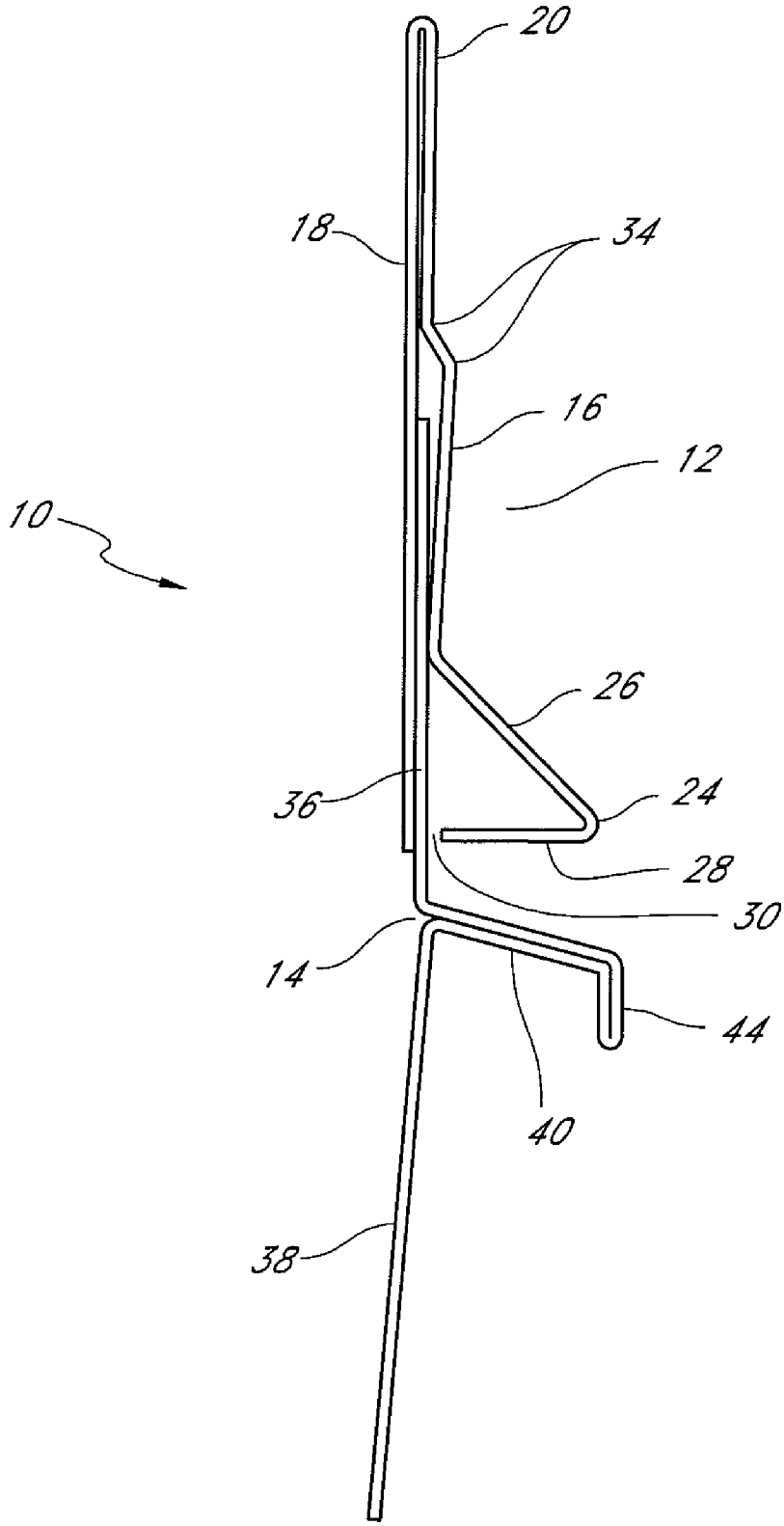
FIG. 1 is a side view of an embodiment of a two-piece expansion joint accessory.

FIG. 1 depicts one embodiment of a two-piece expansion joint 10 which generally comprises an upper piece 12 and a lower piece 14. The upper piece comprises a front leg 16 and may also include a back leg 18 in certain embodiments. The front leg 16 acts as a flashing leg and at the top of the front leg there is a fastening flange 20. Below the fastening flange 20 and flashing portion of the front leg 16 is a sloped screed 24. The sloped screed 24 includes a sloped portion 26 and a bottom portion 28. A space 30 is provided between the bottom portion 28 of the sloped screed 24 and the male leg 36 so that water draining through a series of weep holes can escape out of the accessory. Near the fastening flange 20, there is a series of bends 34 in the front leg which forces the sloped screed 24 to press up against the male leg 36 of the lower piece 14.

The lower piece 14 of the embodiment shown in FIG. 1 generally comprises a male leg 36, a fastening leg 38, and a flashing leg 40. At the end of the flashing leg 40 there is a return key 44 which prevents water from entering the stucco assembly. The male leg 36 slides between the front leg 16 and the wall, or if the embodiment includes a back leg 18, then it fits between the back leg 18 and the front leg 16. Before fastening an embodiment to a wall joint, the fastening leg 38 may be bent back towards the wall, as shown in FIG. 1, so as to align the wall joint.

Figure 2:
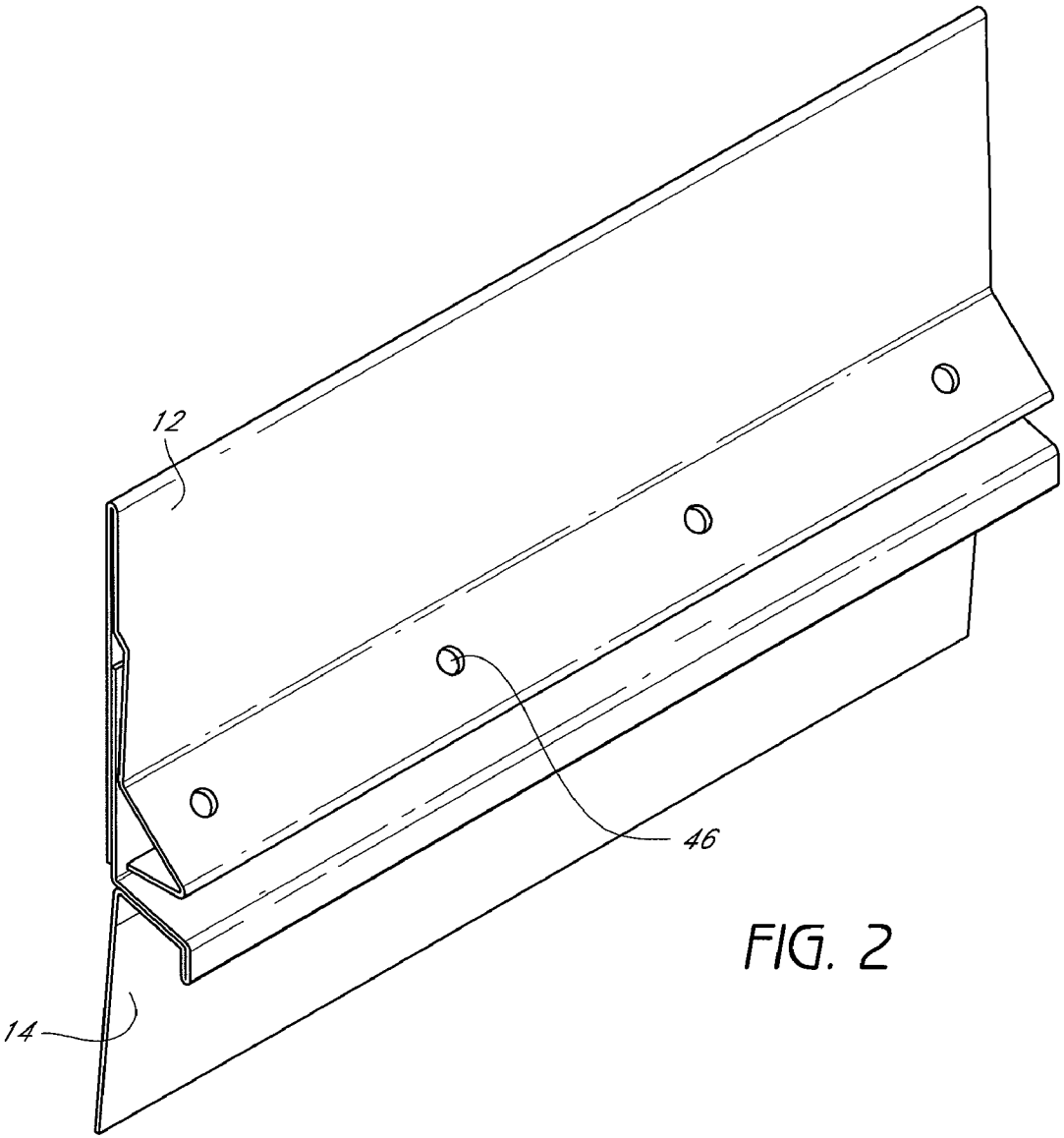
FIG. 2 is a perspective view of an embodiment of a two-piece expansion joint accessory.

FIG. 2 shows a perspective view of the two-piece embodiment 10 in FIG. 1 with the bottom piece 14 inserted into the upper piece 12. Several weep holes 46 are positioned along the sloped portion of the sloped screed.

Figure 3:
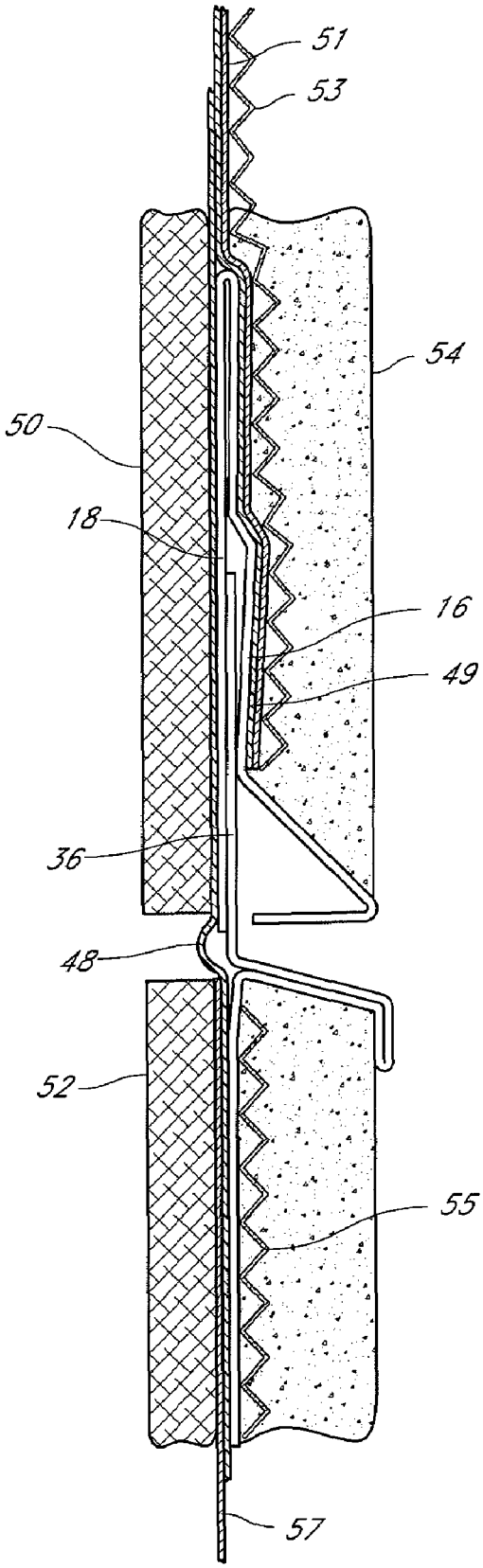
FIG. 3 is a cross sectional view of an embodiment of a two-piece expansion joint accessory installed at a joint in a stucco wall.

FIG. 3 depicts the embodiment of FIG. 1 as it could be installed in a stucco wall at a joint between two wall members, such as a floor line, etc. The assembly benefits from the sequence of applying the materials and device. Water resistant barrier (hereinafter "WRB") 57 is installed horizontally across the sheathing of the bottom panel 52. A layer of self-adhesive flashing (hereinafter "SAF") 48 is installed horizontally onto the sheathing of the upper wall panel 50 and overlapping onto the WRB 57 on the lower panel 52. The upper piece is attached to the upper panel 50, over the SAF 48, by way of a fastener through the attachment flange. The lower piece is attached to the lower panel 52, over the SAF 48, leaving a gap between the pieces for expansion movement in the joint. A layer of SAF 49 is installed horizontally over the upper panel 50, from above the first layer of SAF 48 and overlapping onto the flashing leg 16 of the upper piece. WRB 51 is installed in a weather bond pattern over the SAF 49. Lath 53 and 55 is installed to the upper and lower wall sections, followed by stucco 54.

As the wall members move relative to each other, the male leg 36 slides within the slot between the front leg 16 and the back leg 18 or upper panel 50 if there is no back leg. During such movement, protection against water infiltration is achieved by the front leg 16 always being pressed against the male leg 36.

Figure 4C:
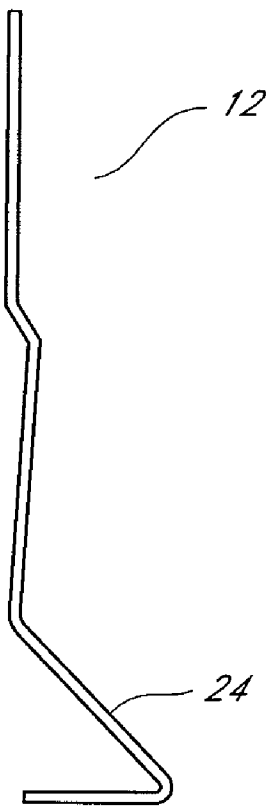
FIGS. 4A, 4B, and 4C are side views of embodiments of an upper piece in a two-piece expansion joint assembly.
Figure 4B:
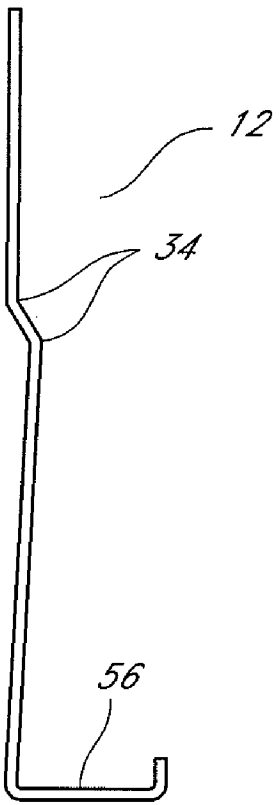
Figure 4A:
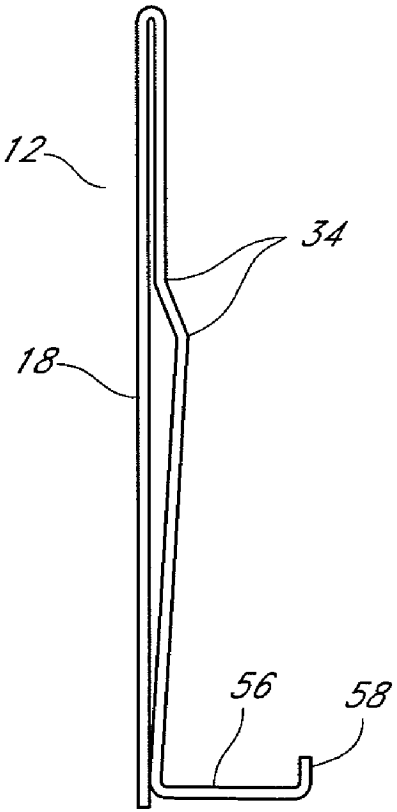

FIGS. 4A, 4B, and 4C show several embodiments of the upper piece of a two-piece stucco accessory. FIG. 4A is an embodiment of an upper piece 12 including a back leg 18 and a series of bends 34 to ensure water protection. Instead of a sloped screed, it comprises a horizontal screed 56 with a return 58. Such an embodiment may be useful for a vertical expansion joint. FIG. 4B is another embodiment of an upper piece 12 which does not have a back leg, but does include a series of bends 34 and a horizontal screed 56. An embodiment of an upper piece 12 without a back leg and including a sloped screed 24 is shown in FIG. 4C. A top piece with a sloped screed 24 may be advantageous in horizontal expansion joints.

Figure 5C:
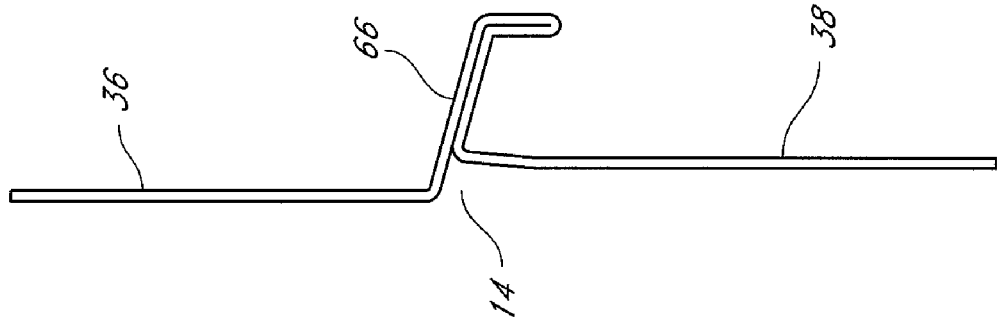
FIGS. 5A, 5B, and 5C are side views of embodiments of a lower piece in a two-piece expansion joint assembly.
Figure 5B:
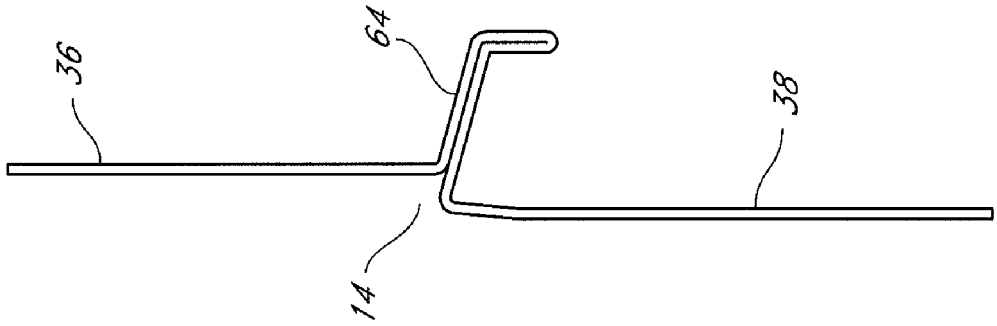
Figure 5A:
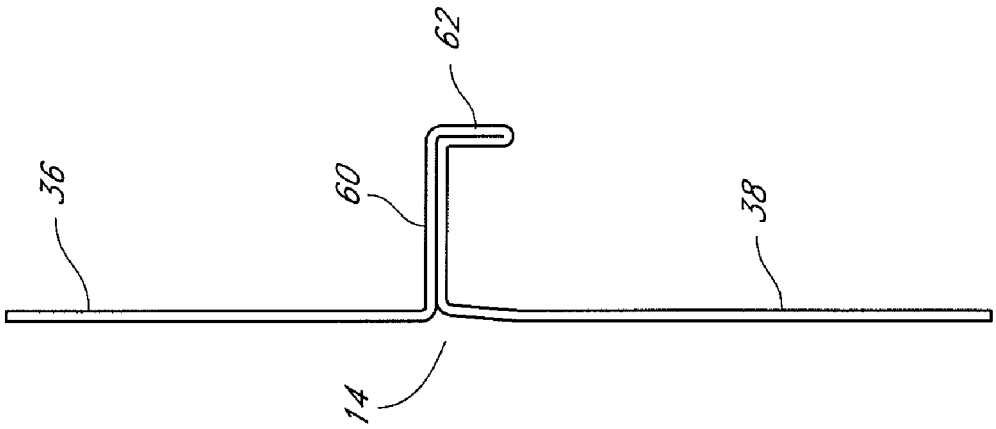

FIGS. 5A, 5B, and 5C depict various embodiments of a lower piece in a two-piece stucco accessory. FIG. 5A shows a lower piece 14 having a male leg 36 aligned with a fastening leg 38, and a horizontal flashing leg 60 with a return key 62. Optionally, the fastening leg and the male leg can be offset as to provide proper alignment where the wall joint is uneven or misaligned, as shown in FIG. 5B and FIG. 5C. In FIG. 5B the male leg 36 is spaced further from the wall side and may be used when the upper portion of the wall extends out further than the portion below the joint. FIG. 5C is an embodiment of a lower piece 14 with a sloped flashing leg 66 and a fastening leg 38 which is offset away from the wall as to accommodate an uneven wall joint where the bottom wall member extends out further than the top wall member.

Figure 6:
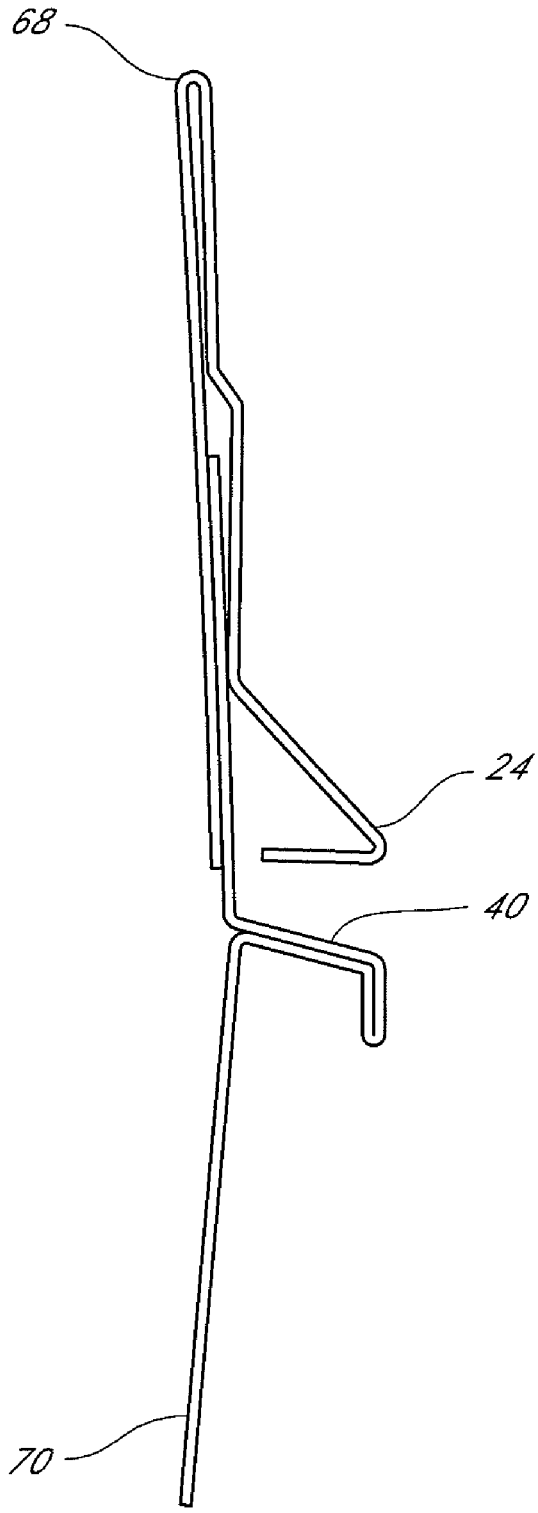
FIG. 6 is a side view of an embodiment of a bowed two-piece expansion joint accessory.
Figure 7:
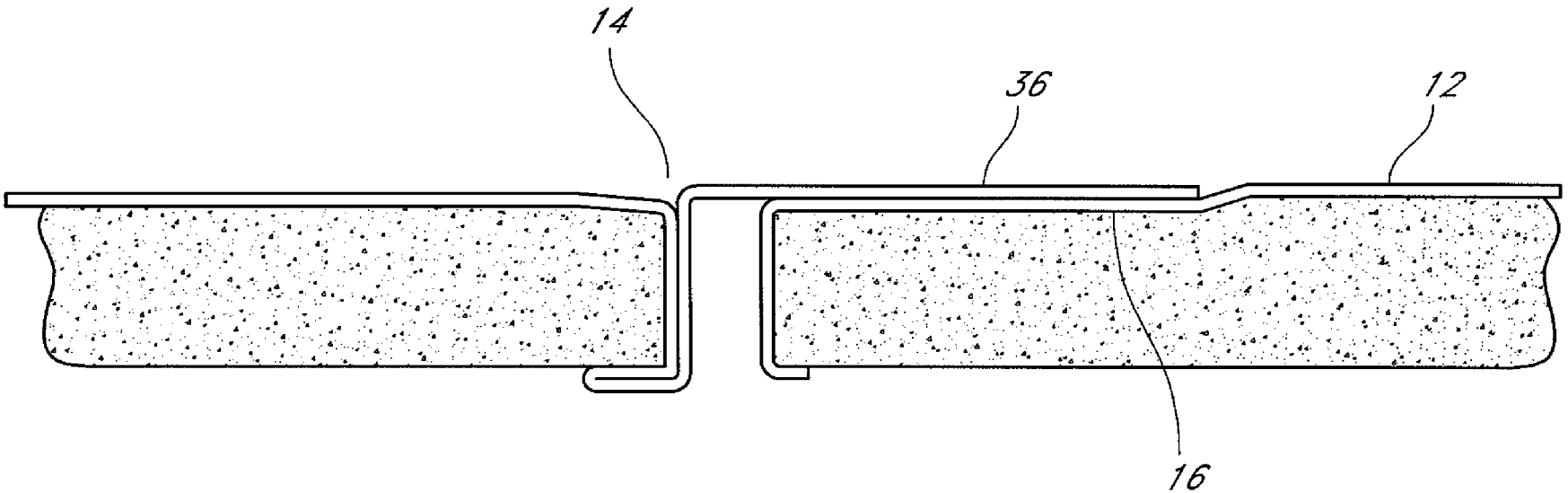
FIG. 7 is a cross sectional view of a two-piece embodiment with stucco connected to each piece, as it would be installed.

FIG. 6 shows embodiments of a two-piece assembly in which the accessory is bowed so that the top end 68 of the front leg and the bottom end 70 of the fastening leg extend further toward the wall side than the screed 24 and flashing leg 40 area. Bowing the accessory in this manner helps ensure alignment at an uneven joint and also helps protect against water infiltration. As shown in FIG. 7, when a bowed embodiment is installed in a stucco wall joint, it flattens vertically and a seal is created between the front leg 16 of the upper piece 12 and the male leg 36 of the lower piece 14.

Figure 8:
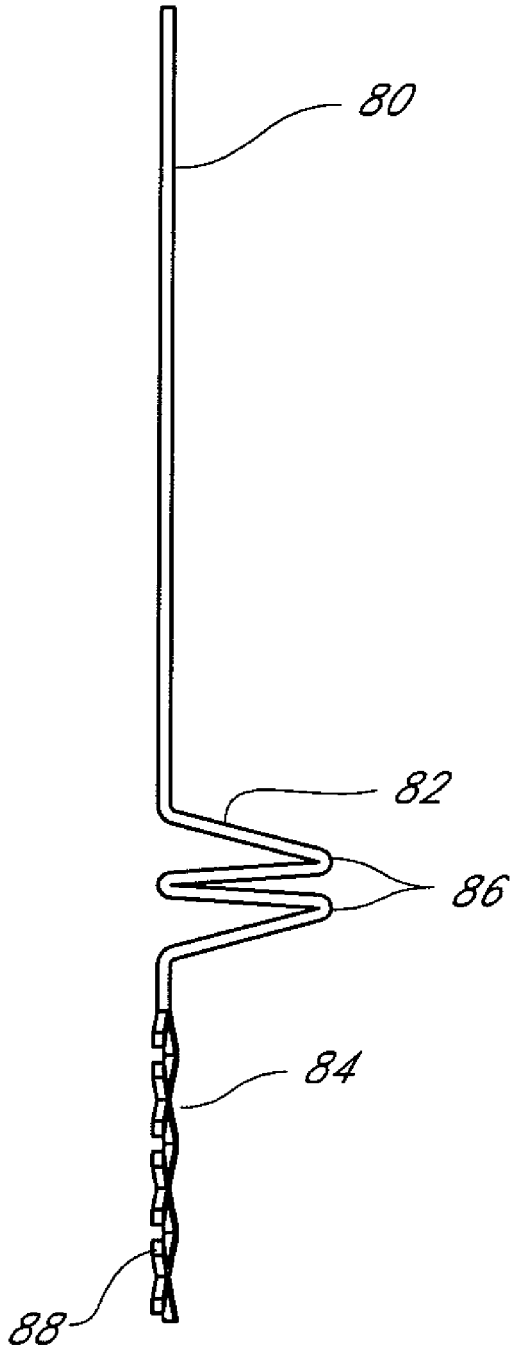
FIG. 8 is a side view of an embodiment of a one-piece control joint accessory.

FIG. 8 depicts an embodiment of a one-piece control joint accessory which generally comprises an upper leg 80, a sloped screed 82, and a lower leg 84. The upper leg 80 is solid and protects against water infiltration while the sloped screed 82 allows water or moisture to drain out of the stucco assembly. As shown, the sloped screed 82 may comprise a series of bends 86 which allows for movement in the joint. The lower leg 84 may comprise expanded metal lath 88, as shown. However, there are many different ways the lower leg 84 can be constructed in order to achieve additional movement in the joint, such as a solid leg with vertical slots or a leg with a drill hole pattern though out.

Figure 9:
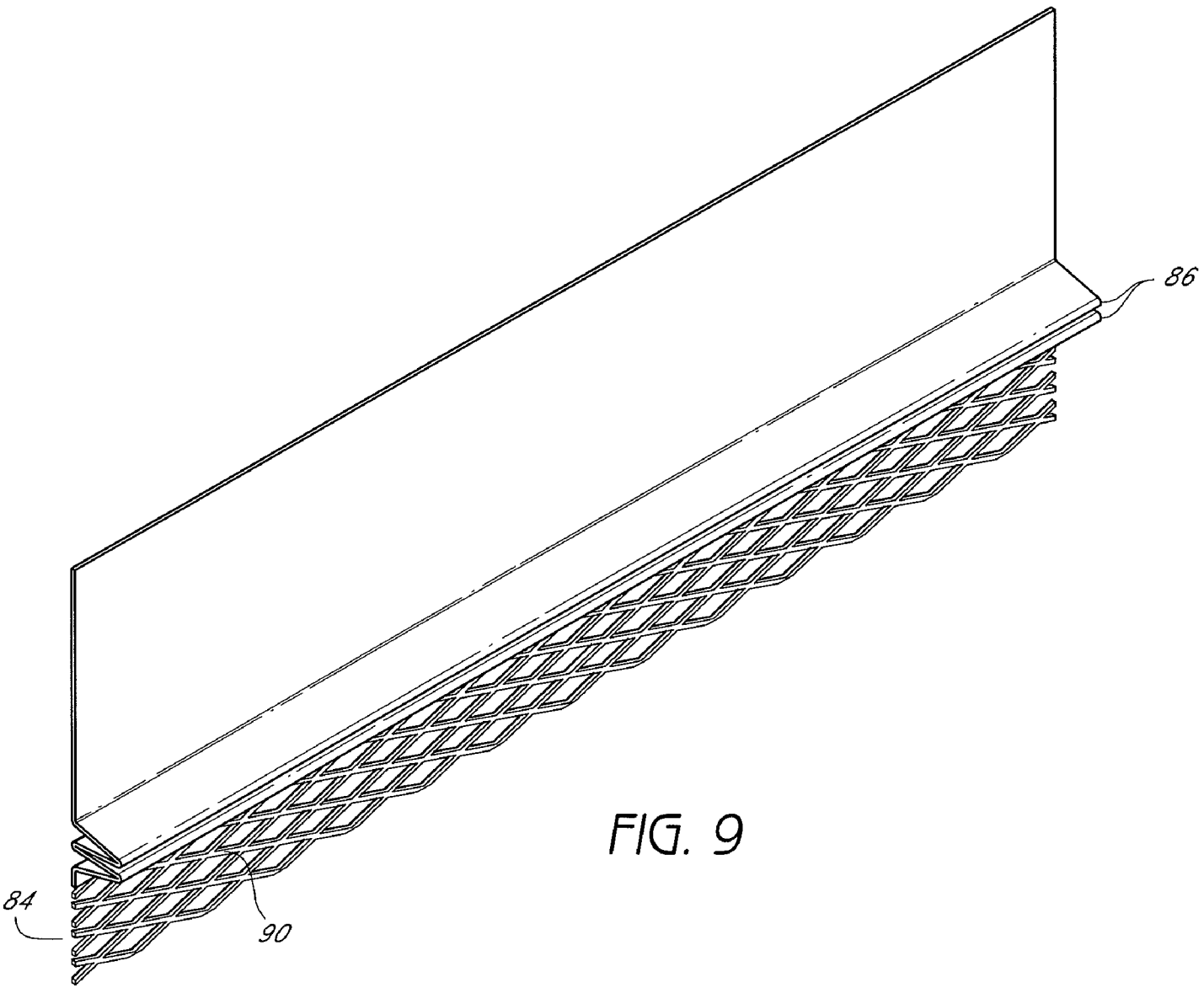
FIG. 9 is a perspective view of a one-piece embodiment with a metal lath leg.

The perspective view in FIG. 9 shows an embodiment of a one-piece accessory including a lower leg 84 comprising metal lath 90 which can be tied to the metal lath generally incorporated in a stucco wall. The series of bends 86 comprising the sloped screed form an aesthetically pleasing line when installed in a wall.

Figure 10:
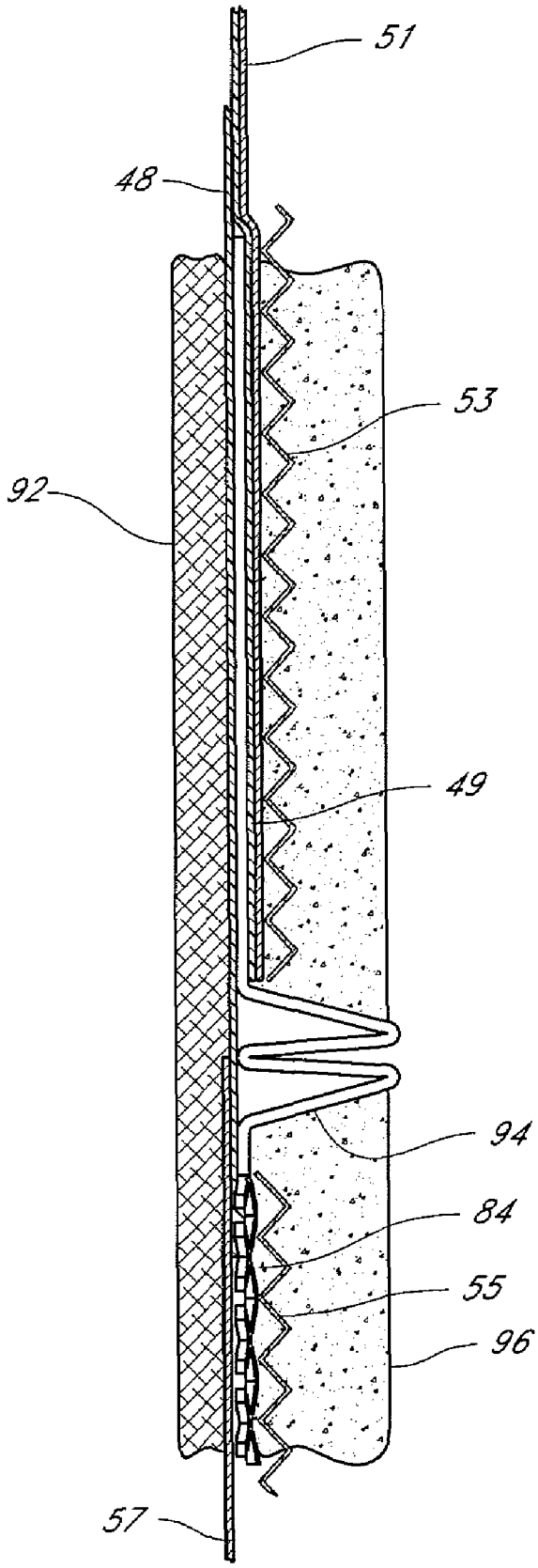
FIG. 10 is a cross sectional view of an embodiment of a one-piece accessory as it can be installed in a stucco wall.

FIG. 10 shows the embodiment of FIG. 8 installed in a stucco wall. The installation sequence can be helpful in preventing water infiltration into the wall. A lower portion WRB 57 can be installed horizontally onto the wall panel 92, starting at the location of the control joint. SAF 48 is installed horizontally over the sheathing of the wall and the WRB 57. An embodiment of the one-piece control joint is attached to the wall assembly over the SAF 48. A second layer of SAF 49 is installed over the flashing leg of the accessory, and WRB 51 can be installed over the SAF 49 in a weather bond pattern. Lath 53 is installed in the upper portion of the joint, and lath 55 is also installed in the lower end of the joint where it can be wire-tied to the lower leg of lath 84. Stucco 96 is then installed in both the upper and lower portions of the joint.

The upper leg can be secured to the wall 92 using nails and the lower leg 84 of metal lath can be secured by wire-tying it to the wall lath, or by using nails or screws, depending on the embodiment. The bottom portion 94 of the sloped screed series of bends can also be horizontal, without a slope, as to protect against water infiltration into the bottom portion of the joint.

Figure 11C:
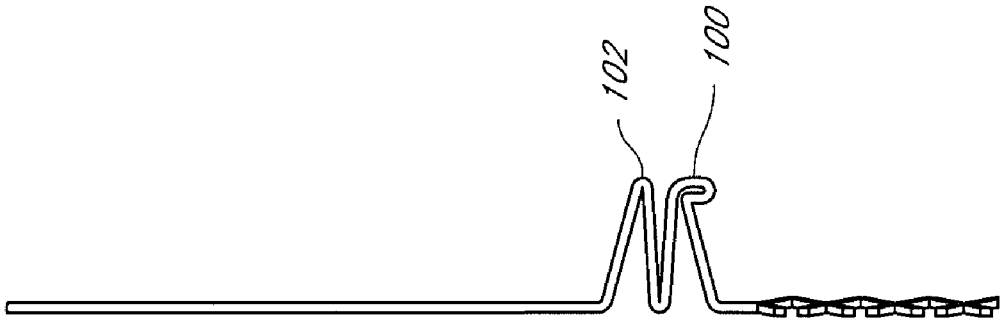
FIGS. 11A, 11B, and 11C are side views of embodiments of a one-piece expansion joint accessory.
Figure 11B:
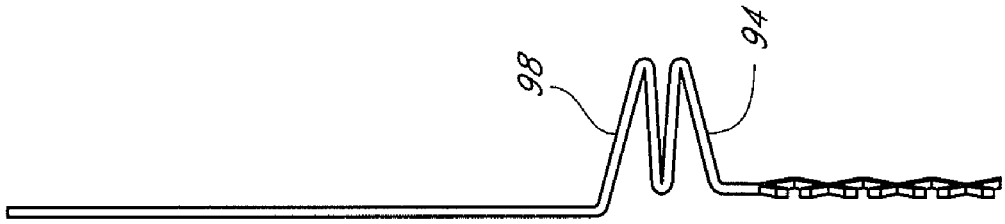
Figure 11A:
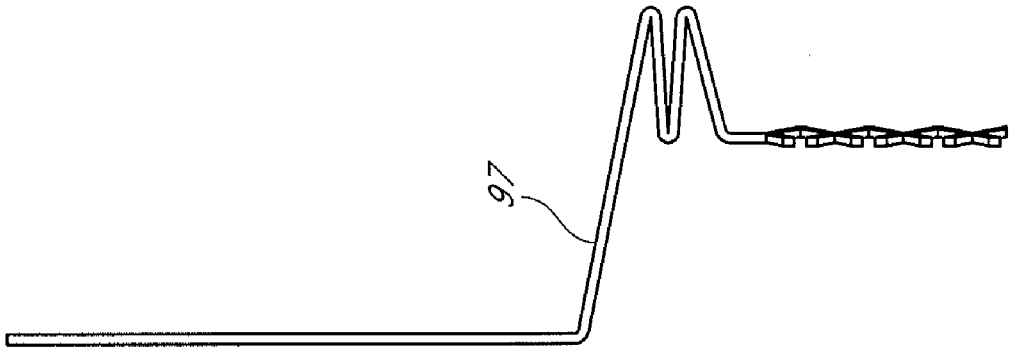

An embodiment of a one-piece expansion joint accessory is shown in FIG. 11A, in which the upper sloped portion 97 of the screed is extended to accommodate an uneven wall joint and assure proper alignment where the bottom portion of the wall extends out further than the top portion. The embodiment of FIG. 11B provides a lesser extension in the screed 98 for a wall Joint that is only slightly uneven. The bottom portion 94 of the screed may also be extended or retracted to help with alignment in uneven wall joints. FIG. 11C shows an embodiment which includes a return key 100 on the lower portion of the sloped screed series of bends 102. A return key 100 can protect against water infiltration into the lower part of the wall joint.

Figure 12:
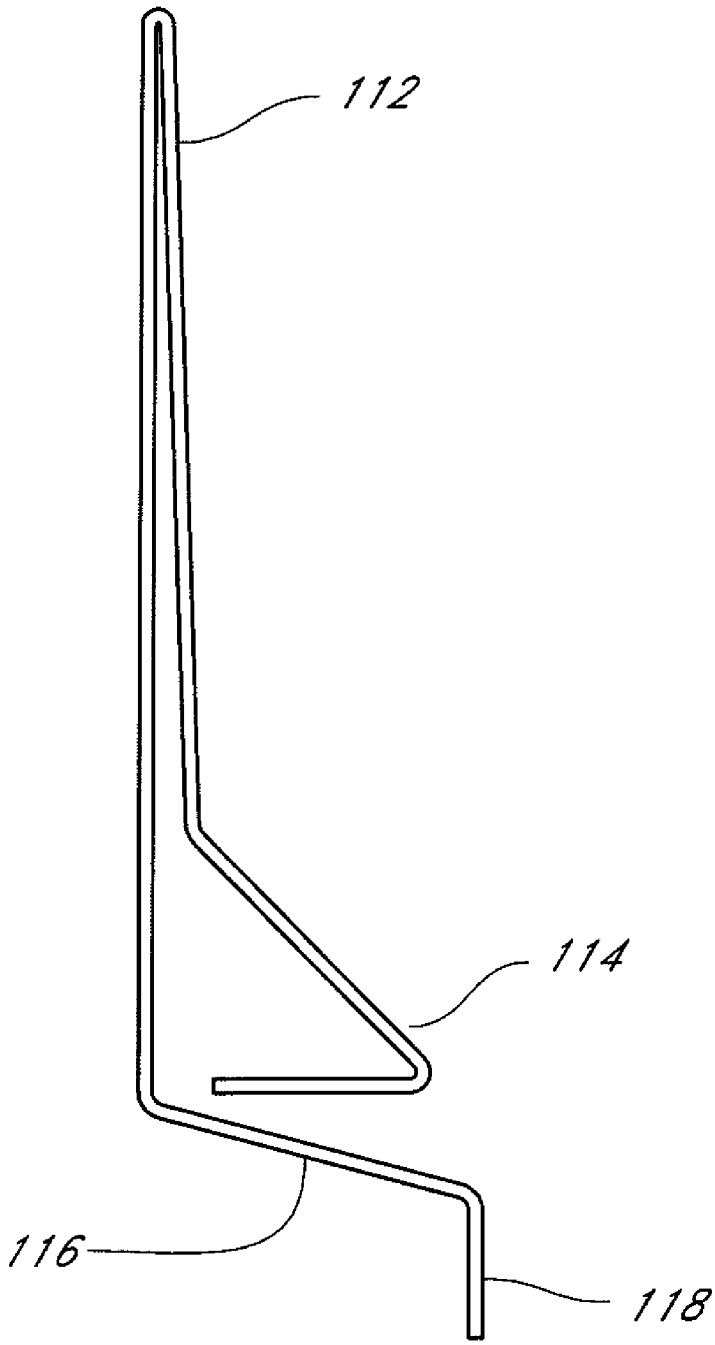
FIG. 12 is a side view of an embodiment of a one-piece accessory which can be used in joints of dissimilar material.

FIG. 12 depicts a one-piece stucco accessory which generally comprises a flashing leg 112, a sloped screed 114, and a counter flashing leg 116. A solid flashing leg 112 protects against water infiltration and provides means for attaching the accessory to the wall. The sloped screed 114 allows water to drain out of the stucco assembly and includes a sloped area which may include weep holes to further promote water drainage. A space exists at the bottom of the slope screed 114 so that water from the weep holes can drain out of the sloped screed. The counter flashing leg 116 connects to the lower section of the wall joint and also diverts water way from the stucco assembly. The counter flashing leg 116 can be configured in many different ways depending on the specific application and whether the wall joint is uneven. A return down leg 118 on the counter flashing leg 116 provides protection against water infiltration even if the lower section of the wall joint moves.

Figure 13:
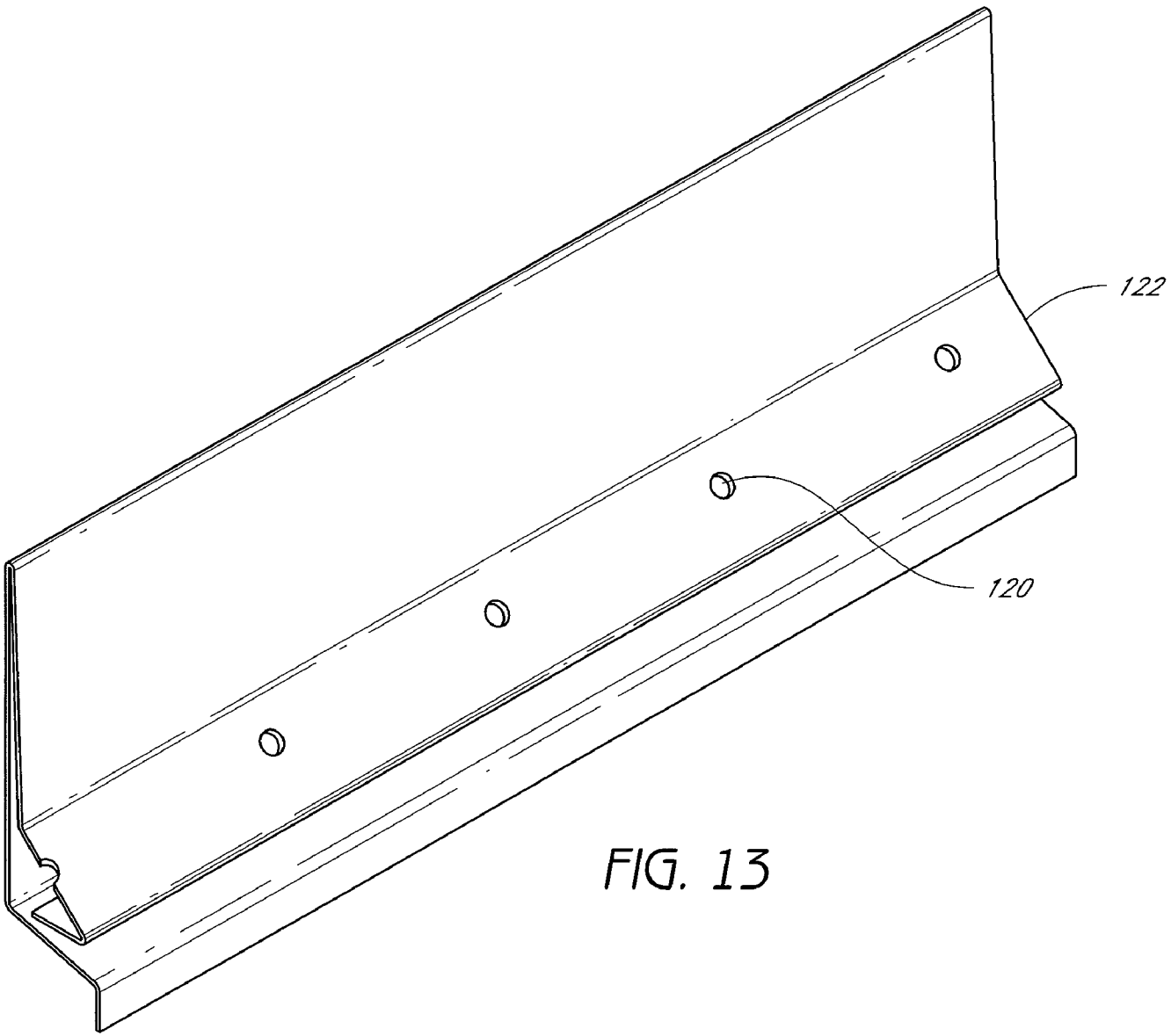
FIG. 13 is a perspective view of an embodiment of a one-piece accessory with weep holes.
Figure 14:
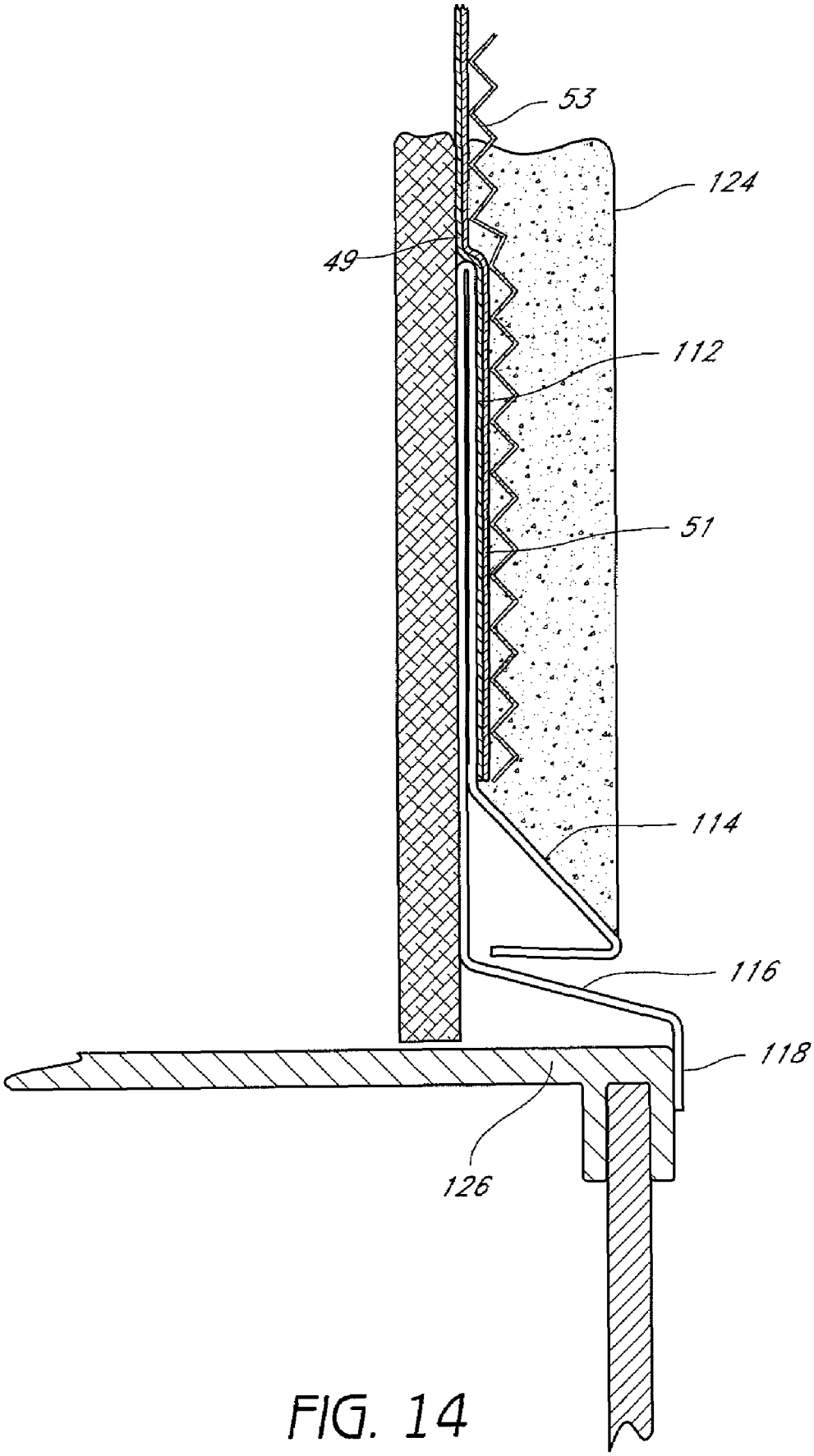
FIG. 14 is a cross sectional view of an embodiment of a one-piece accessory installed in a joint with uneven and dissimilar sections.

FIG. 13 shows the one-piece embodiment of FIG. 12 including weep holes 120 in the sloped portion of the sloped screed 122. FIG. 14 shows a similar embodiment installed at a wall joint between dissimilar surfaces. In order to further protect against water infiltration, the flashing leg 112 is fastened to the upper wall panel, and SAF 49 is installed over the wall panel and the flashing leg 112. WRB 51 can be installed over the SAF 49, and lath 53 can then be installed along with stucco 124. The counter flashing leg 116 extends out over the lower, dissimilar section of the wall 126, and a return key 118 extends vertically over the lower section 126. This embodiment is particularly useful in joints with dissimilar materials such as windows, doors, vents, etc.

Figure 15C:
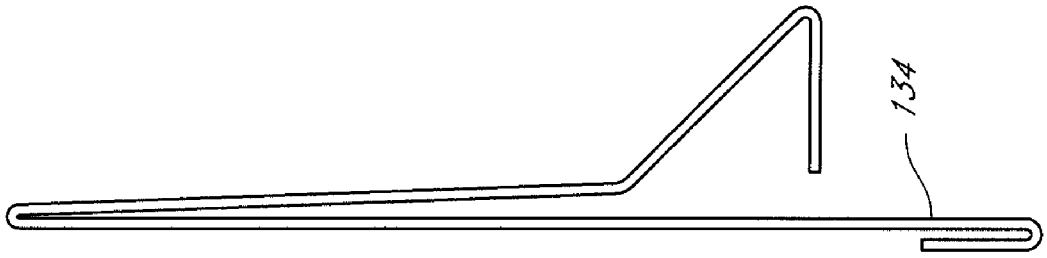
FIGS. 15A, 15B, and 15C are side views of embodiments of a one-piece accessory with differently shaped counter flashing legs.
Figure 15B:
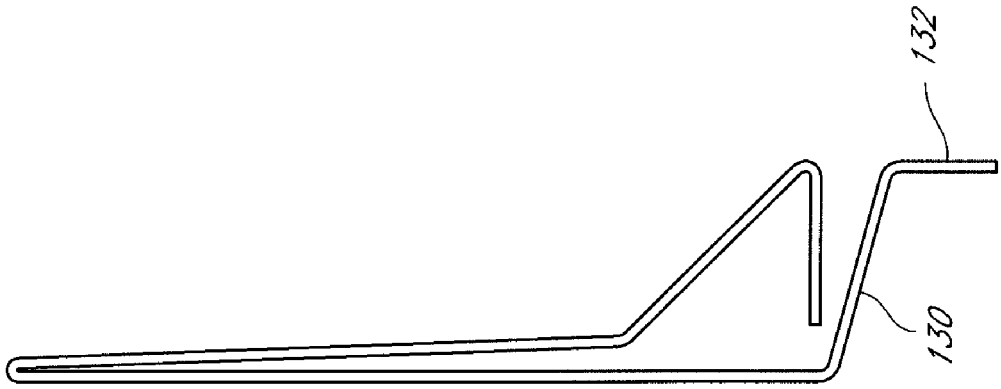
Figure 15A:
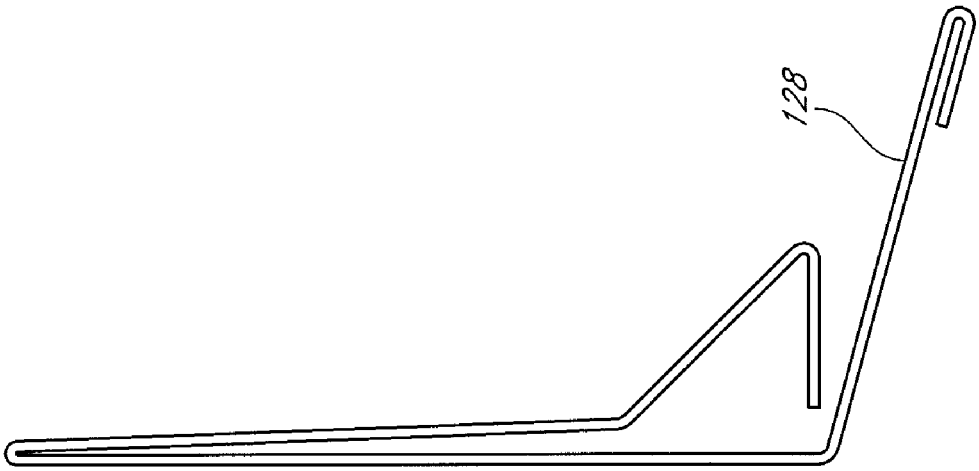

Another embodiment of a one-piece accessory, as shown in FIG. 15A, includes an extended counter flashing leg 128 to prevent water infiltration between dissimilar materials or at the base of a wall. The one-piece embodiment in FIG. 15B includes a slightly extended counter flashing leg 130 and a return key 132 which can help with alignment and water protection in a joint of dissimilar materials which is uneven and has relative movement. In the embodiment of FIG. 15C, the counter flashing leg 134 extends straight down in order to protect waterproof membranes at the base of a wall.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Thus, it is intended that the scope of the present invention herein disclosed should not be limited by the particular embodiments described above, but should be determined only by a fair reading of the claims that follow.

What is claimed is:

1. A stucco wall device configured for use at a construction joint location, the device comprising:

a first member having a front leg and a back leg that extend side-by-side in a vertical direction, a lower end of the front leg defining a sloped screed adapted to direct water away from the wall, the sloped screed having weep holes for additional water drainage, and the front leg comprising a plurality of bends above the sloped screed such that the front leg cooperates with the back leg to define a space between a forward surface of the back leg and a rearward surface of the front leg, the front leg and the back leg defining a bottom opening to the space;

a second member including an extension leg configured to extend through the bottom opening and into the space between the front leg and the back leg of the first member, wherein the bottom opening is sized to tightly receive the extension leg, the second member further comprising a flashing leg below the extension leg and configured to keep water from entering the stucco wall, and a fastening leg below the flashing leg;

wherein the extension leg is movable within the space to permit relative vertical movement between the first member and the second member while inhibiting the infiltration of water between the front leg of the first member and the extension leg of the second member, and wherein each of the first member and the second member are bowed along a vertical direction such that, when the first member and the second member are assembled to one another, a central portion of a rear surface of the device is spaced forward of a plane containing an upper end and a lower end of the rear surface of the device.

2. The device of claim 1, wherein the plurality of bends are configured to exert a pressure against the extension leg in order to protect against water infiltration within the joint.

3. The device of claim 1, wherein the front leg and the back leg are formed from a single piece of material folded onto itself.

4. The device of claim 1, wherein the sloped screed determines a thickness of a stucco layer applied to cover the first member and the flashing leg determines a thickness of a stucco layer applied to cover the flashing leg of the second member, wherein the sloped screed and the flashing leg are sized such that the outer surfaces of the sloped screed and the flashing leg stucco layers are aligned in a vertical direction.

5. The device of claim 1, further comprising a return key extending in a downward direction from an outer end of the flashing leg.

6. The device of claim 5, wherein the return key is integrally formed with the flashing leg.

7. The device of claim 6, wherein the extension leg, the flashing leg, the return key and the fastening leg are formed from a single piece of material.

8. The device of claim 7, wherein the flashing leg is formed of a double layer of material.

9. The device of claim 1, wherein the extension leg, the flashing leg and the fastening leg are formed from a single piece of material.

10. The device of claim 9, wherein the flashing leg is formed of a double layer of material.

11. The device of claim 1, wherein the extension leg is movable within the space to permit relative lateral movement between the first member and the second member.

12. A stucco wall construction joint system, comprising:

an upper wall panel;

a lower wall panel;

a first member secured to the upper wall panel, the first member having a front leg and a back leg, a lower end of the front leg defining a sloped screed adapted to direct water away from the wall, the sloped screed having weep holes for additional water drainage, wherein the front leg and the back leg extend side-by-side in a vertical direction and cooperate to define a vertically-extending space between a forward surface of the back leg and a rearward surface of the front leg, the front leg and the back leg defining a bottom opening to the space;

a second member secured to the lower wall panel, the second member including an extension leg configured to extend through the bottom opening and into the space between the front leg and the back leg of the first member, wherein the bottom opening is sized to tightly receive the extension leg, the second member further comprising a flashing leg and a fastening leg, wherein the flashing leg is positioned between the extension leg and the fastening leg in a vertical direction and the flashing leg extends outwardly from the lower wall panel;

an upper layer of stucco applied to the upper wall panel and covering the front leg of the first member;

a lower layer of stucco applied to the lower wall panel and covering the fastening leg of the second member;

wherein the extension leg is movable within the space to accommodate relative vertical movement of the upper wall panel and the lower wall panel while inhibiting the infiltration of water between the front leg of the first member and the extension leg of the second member, and wherein each of the first member and the second member are bowed along a vertical direction such that, when the first member and the second member are assembled to one another, a central portion of a rear surface of the device is spaced forward of a plane containing an upper end and a lower end of the rear surface of the device.

13. The stucco wall construction joint system of claim 12, further comprising an upper water resistant barrier layer between the front leg of the first member and the upper layer of stucco, wherein the upper water resistant barrier layer extends from above the first member past a juncture between the upper wall panel and the first member and covers a portion of the front leg above the sloped screed.

14. The stucco wall construction joint system of claim 13, further comprising a lower water resistant barrier layer between the lower wall panel and the fastening leg of the second member.

15. The stucco wall construction joint system of claim 14, further comprising a layer of self-adhesive flashing positioned between the upper wall panel and the first member and between the lower wall panel and the second member, wherein the layer of self adhesive flashing extends from above the first member to below the second member.

16. The stucco wall construction joint system of claim 15, wherein the upper water resistant barrier layer is positioned on the outside of the layer of self-adhesive flashing and the layer of self-adhesive flashing is positioned on the outside of the lower water resistant barrier layer.

17. The stucco wall construction joint system of claim 12, wherein the front leg and the back leg are formed from a single piece of material folded onto itself.

18. The stucco wall construction joint system of claim 12, wherein the sloped screed determines a thickness of the upper layer of stucco and the flashing leg determines a thickness of the lower layer of stucco, wherein the sloped screed and the flashing leg are sized such that the outer surfaces of the upper and lower layers of stucco are aligned in a vertical direction.

19. The stucco wall construction joint system of claim 12, further comprising a return key extending in a downward direction from an outer end of the flashing leg.

20. The stucco wall construction joint system of claim 19, wherein the extension leg, the flashing leg, the return key and the fastening leg are formed from a single piece of material.

21. The stucco wall construction joint system of claim 20, wherein the flashing leg is formed of a double layer of material.

22. The stucco wall construction joint system of claim 12, the extension leg is movable within the space to accommodate relative vertical movement of the upper wall panel and the lower wall panel.

* * * * *